US008377226B2

(12) United States Patent
Favaro et al.

(10) Patent No.: US 8,377,226 B2
(45) Date of Patent: Feb. 19, 2013

(54) DISHWASHER, PARTICULARLY FOR FITTED KITCHENS

(75) Inventors: Daniele Favaro, Pramaggiore (IT); Roberto Pezzetta, Roveredo in Piano (IT); Graziano Lazarotto, Pieve di Soligo (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 826 days.

(21) Appl. No.: 10/525,627

(22) PCT Filed: Aug. 19, 2003

(86) PCT No.: PCT/EP03/09172

§ 371 (c)(1),
(2), (4) Date: May 16, 2005

(87) PCT Pub. No.: WO2004/023968

PCT Pub. Date: Mar. 25, 2004

(65) Prior Publication Data

US 2005/0211278 A1 Sep. 29, 2005

(30) Foreign Application Priority Data

Aug. 30, 2002 (IT) ..... PN2002A0064

(51) Int. Cl.
*B08B 3/00* (2006.01)

(52) U.S. Cl. ..... 134/56 D; 134/57 D; 134/176; 134/198

(58) Field of Classification Search ..... 134/56 D, 134/57 D, 176
See application file for complete search history.

(56) References Cited

U.S. PATENT DOCUMENTS

| | | | | | |
|---|---|---|---|---|---|
| 3,861,769 | A * | 1/1975 | Jenkins | 312/311 |
| 4,064,887 | A * | 12/1977 | Geiger et al. | 134/144 |
| 4,765,697 | A * | 8/1988 | Gardell et al. | 312/229 |
| 5,215,491 | A * | 6/1993 | Willet et al. | 446/176 |
| 6,596,232 | B1 * | 7/2003 | Lin et al. | 422/28 |
| 7,032,604 | B2 * | 4/2006 | Welch | 134/135 |

FOREIGN PATENT DOCUMENTS

| | | | |
|---|---|---|---|
| FR | 2 606 990 | | 5/1988 |
| JP | 63-154150 | * | 6/1988 |
| JP | 2000-107116 | | 4/2000 |
| JP | 2000107116 | * | 4/2000 |
| JP | 2001-204678 | | 7/2001 |

* cited by examiner

*Primary Examiner* — Michael Kornakov
*Assistant Examiner* — Nicole Blan
(74) *Attorney, Agent, or Firm* — Pearne & Gordon LLP

(57) ABSTRACT

This invention relates to an automatic dishwasher, especially for built-in kitchenettes, comprising a cabinet 10 and equipped with a front door 11 that seals the wash tub 18 housing at least one first and one second spray arm 20, 21 for washing the dishes placed in at least one rack 19, said tub being closed on the bottom by a downward sloping panel 22 that directs the wash water into a sump hopper 23 that serves to collect and drain the water, with the horizontal as well as vertical capacity of the dishwasher enhanced in that the first spray arm 20 essentially extends coaxially with the sump hopper 23 while the second spray arm 21 is positioned above the sloped bottom panel 22 with its axis of rotation extending at a right angle to said panel.

13 Claims, 5 Drawing Sheets

DISHWASHER, PARTICULARLY FOR FITTED KITCHENS

This invention relates to an automatic dishwasher, especially for built-in kitchenettes, functionally laid out in a horizontal direction so as to accommodate a complete load of dishes on one single level.

Modern built-in kitchens can essentially be divided into three design categories: Baseboard-mounted kitchen cabinets, kitchen cabinets on legs, and wall-suspended cupboards.

Baseboard-mounted kitchen cabinets allow for utilization of the vertically available space essentially all the way to the floor. This permits easy insertion and integration of conventional dishwashers, designed to accept dishes on two racks one above the other, in the overall kitchen cabinetry. For their installation, the top panel of the dishwasher is removed and the machine slides in under the kitchen countertop.

Kitchen cabinetry with the lower cabinet supported on legs offers considerably less vertically available space, and the choice of usable dishwashers is limited to special designs which, however, will in any event have a reduced load capacity compared to corresponding standard dishwasher models.

The traditional wall-suspended kitchen cupboards, attached to wall-mounted tracks, do not permit the integration of a dishwasher into the kitchen cabinetry and require the use of a self-supporting machine, separate from the cabinetry and installed on specially adapted columns next to the cupboards.

U.S. Pat. No. 2,960,990 describes an automatic dishwasher so designed as to permit stand-alone installation as well as integration into built-in cabinetry. The dishwasher concerned has a single rack and two spray arms which, in a first design version, rotate on two parallel, partly overlapping planes, while in a second version they rotate on the same horizontal plane, requiring a special synchronizing mechanism to avoid mutual interference during rotation. The shortcomings of the solution described consist primarily in the substantial space requirements of the hydraulic assembly (spray arm, pump, motors) due to the special positioning of the spray arms, which severely limits the dish load capacity especially of the built-in model; but also in the need for relatively complicated controls for operating the machine. Another considerable drawback of a dishwasher of that type lies in the inability to use standard modular trim panels on the dishwasher door, a must for built-in kitchenettes.

The primary objective of this invention is an automatic dishwasher that can be used in any built-in kitchen configuration, including in particular the suspended, wall-mounted versions.

Another objective of the invention is a dishwasher of a particularly advantageous design in ergonomic terms even when the machine is not integrated in a built-in kitchenette, while in any event accepting standard-size trim panels.

Another objective of the invention is a dishwasher which to a maximum extent permits the use of conventional components and processes employed in traditional machines while matching the load capacity of the latter (12 standard place settings) even with only one dish loading level.

These objectives are achieved with an automatic dishwasher that offers the features specified in the claims at the end of this patent document.

The following description, which serves as a non-limiting example only, explains the advantages and features of the dishwasher according to this invention, with reference to the attached drawings in which.

Figure 2:
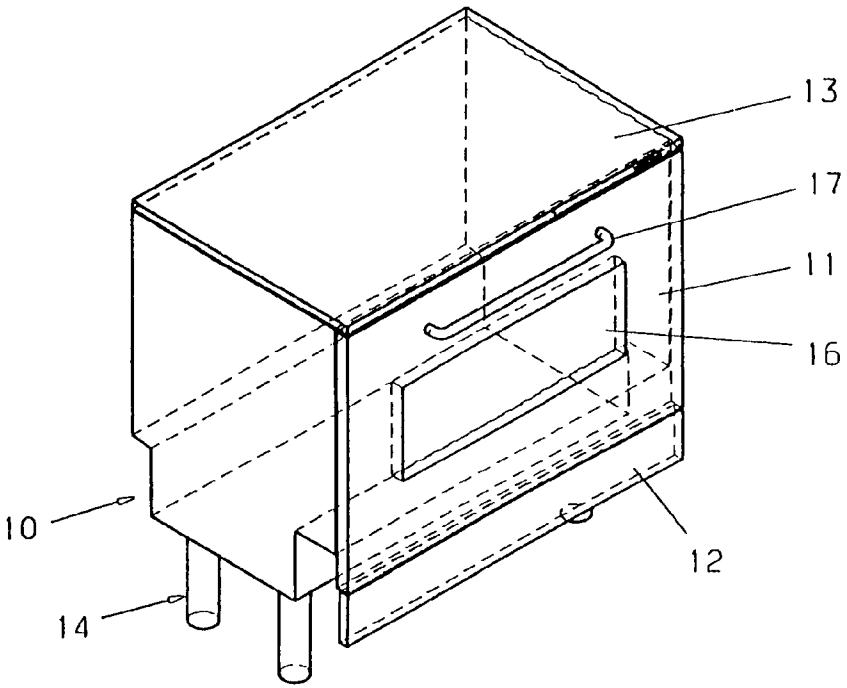
FIG. 2 is a schematic, perspective view of the dishwasher cabinet according to a second implementation of the invention.
Figure 1:
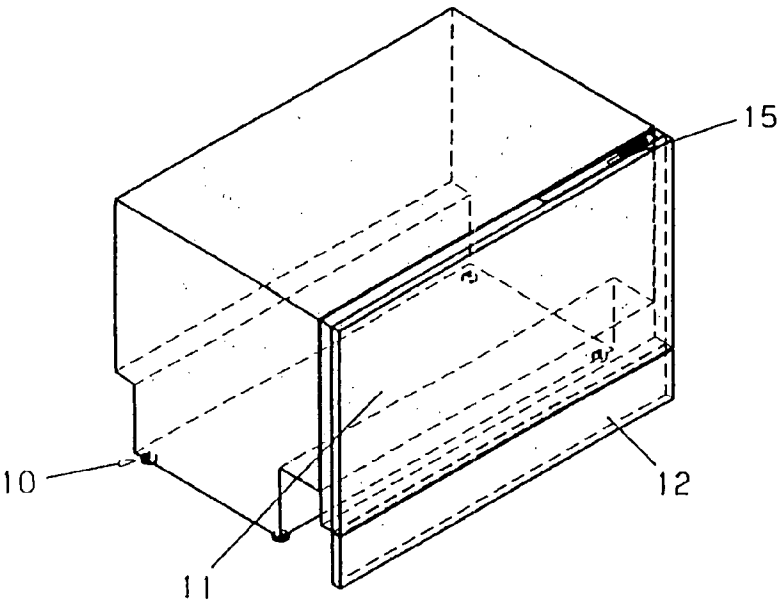
FIG. 1 is a schematic, perspective view of the dishwasher cabinet according to a first implementation of the invention.

The dishwashers illustrated in FIGS. 1 and 2 differ from each other in that the first design lends itself to being integrated in a built-in, fitted kitchenette, whereas the second design is that of a self-supporting stand-alone model. The dishwasher according to FIG. 1 includes a cabinet 10 with a front door 11 and perhaps a baseboard 12, whereby the machine can be integrated into the overall kitchen cabinetry, whether under the countertop or as a suspended wall-mounted version. Analogous to the version depicted in FIG. 1, the dishwash machine per FIG. 2 encompasses a cabinet 10, a door 11 and a baseboard 12, but additionally a top panel 13 as well as four legs 14 by which it stands on the floor.

A comparison of FIGS. 1 and 2 shows that either cabinet can be provided with a solid door (FIG. 1) featuring a trim panel 15 or a transparent window door 16 (FIG. 2) with an outside handle 17. The dishwasher according to this invention thus permits a highly versatile array of features, allowing it to be adapted to a range of different installation requirements especially in the case of built-in kitchenettes in which the appliances must be matched with the other kitchen furniture.

Figure 3:
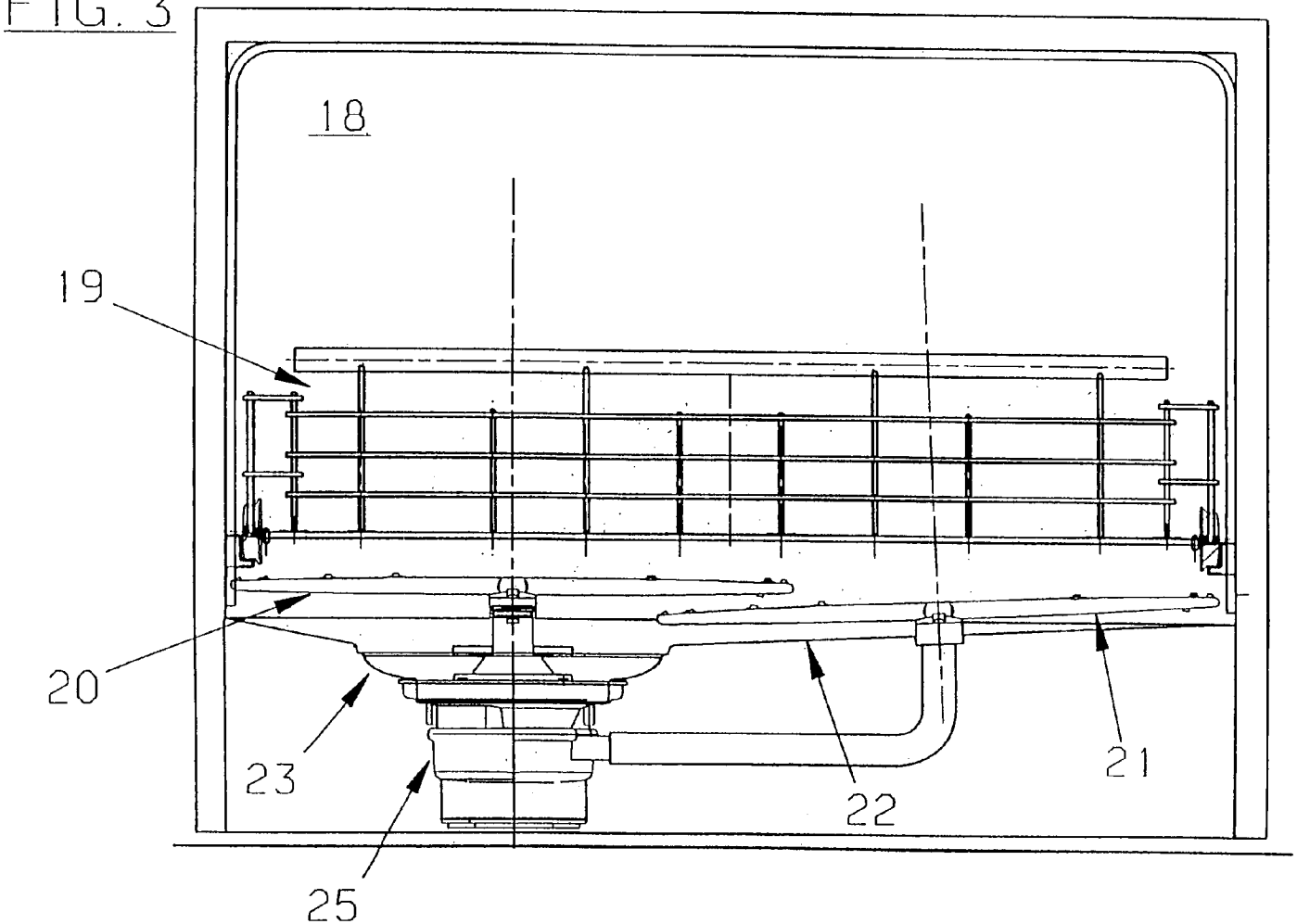
FIG. 3 is a schematic front view of the dishwasher per FIG. 1 or 2.
Figure 4:
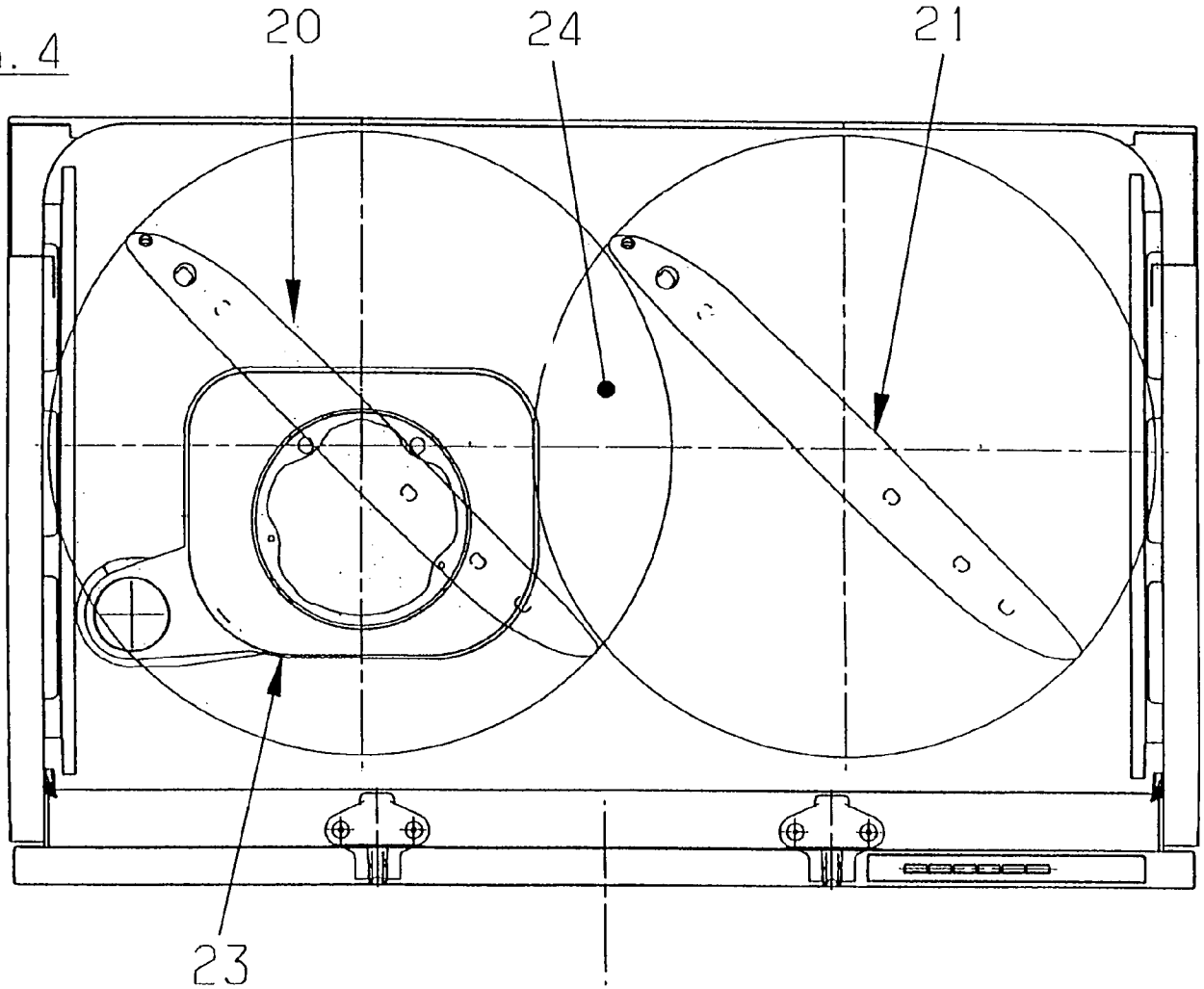
FIG. 4 is a schematic top view of the dishwasher per FIG. 1 or 2.

The dishwasher according to the invention incorporates a tub 18 that accommodates the single rack 19 for loading the dishes to be washed, and the two spray arms 20, 21 that spray the dishes with dish water (FIG. 3). The tub 18 is closed on the bottom by a panel 22 that slopes off so as to direct the dish water into a sump hopper 23 that collects and drains the liquid. As can be seen, the sump hopper is advantageously located off-center on the tub bottom, its vertical axis extending parallel to the central axis of the tub.

One important feature of the invention is the special positioning of the spray arms 20, 21. The first arm is mounted above the sloping panel 22, with its axis of rotation essentially extending at a right angle to the said panel. It is indeed important that the spray arm 21 be mounted with its axis tilted relative to the vertical line of an angle that must be so chosen as to optimize both its space economy within the tub and the functionality of the washing system. Moreover, the plane of rotation of the second spray arm 21 extends partly underneath that of the main spray arm 20. This configuration of the spray arms offers various advantages, such as reduced space requirements of the wash assembly in the vertical as well as horizontal direction with a resulting increase in the dish load capacity; and the creation of a high-intensity wash zone 24 at the point where the two planes of rotation of the spray arms overlap.

Of course, the advantages of the design described are further enhanced by using a compact, low-profile motor-pump assembly 25 that permits the direct feeding of water to the main spray arm 20, with a lateral branch feeding the secondary spray arm 21 (FIG. 3).

Figure 5:
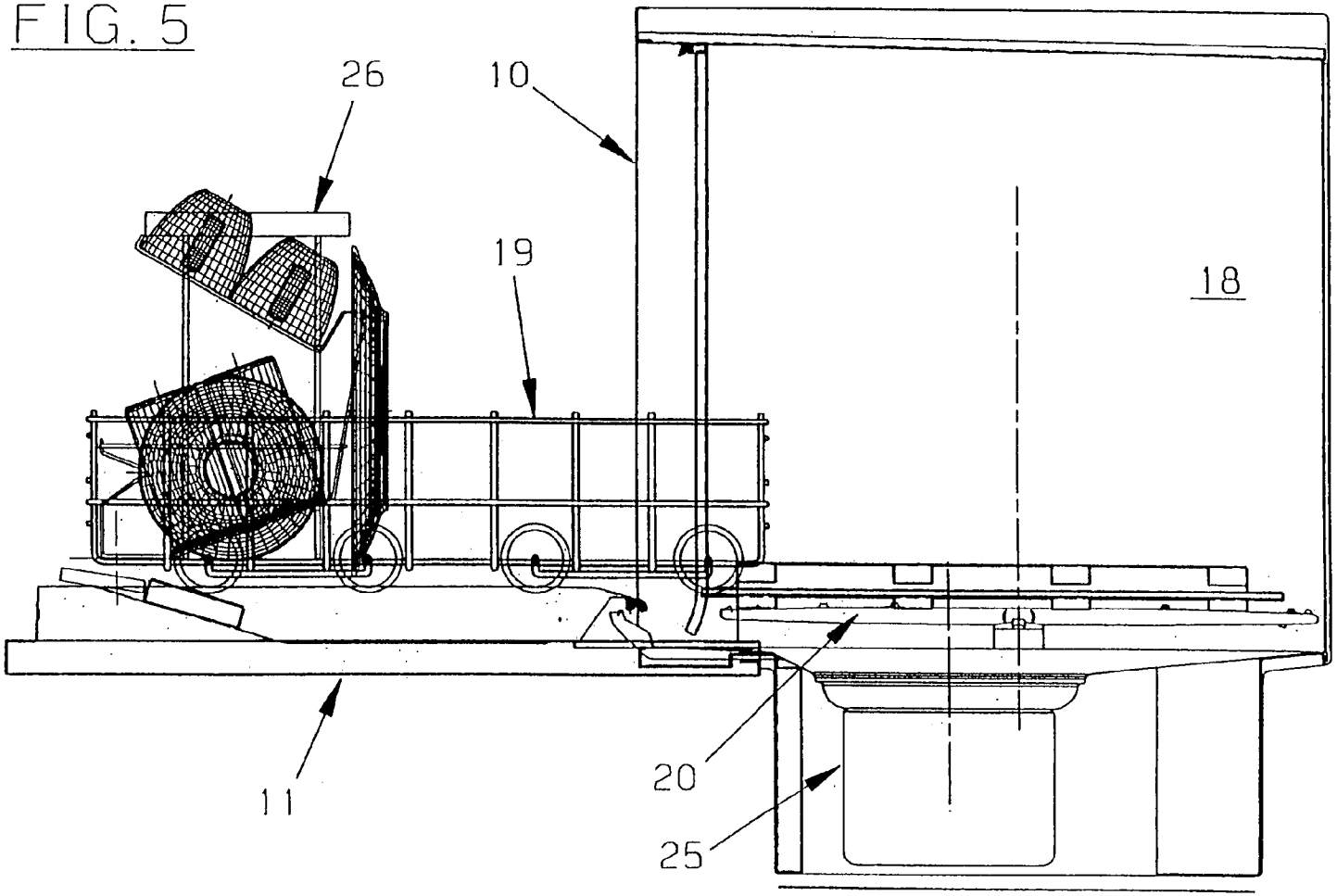
FIG. 5 is a schematic side view of the dishwasher per FIG. 1 or 2.
Figure 6:
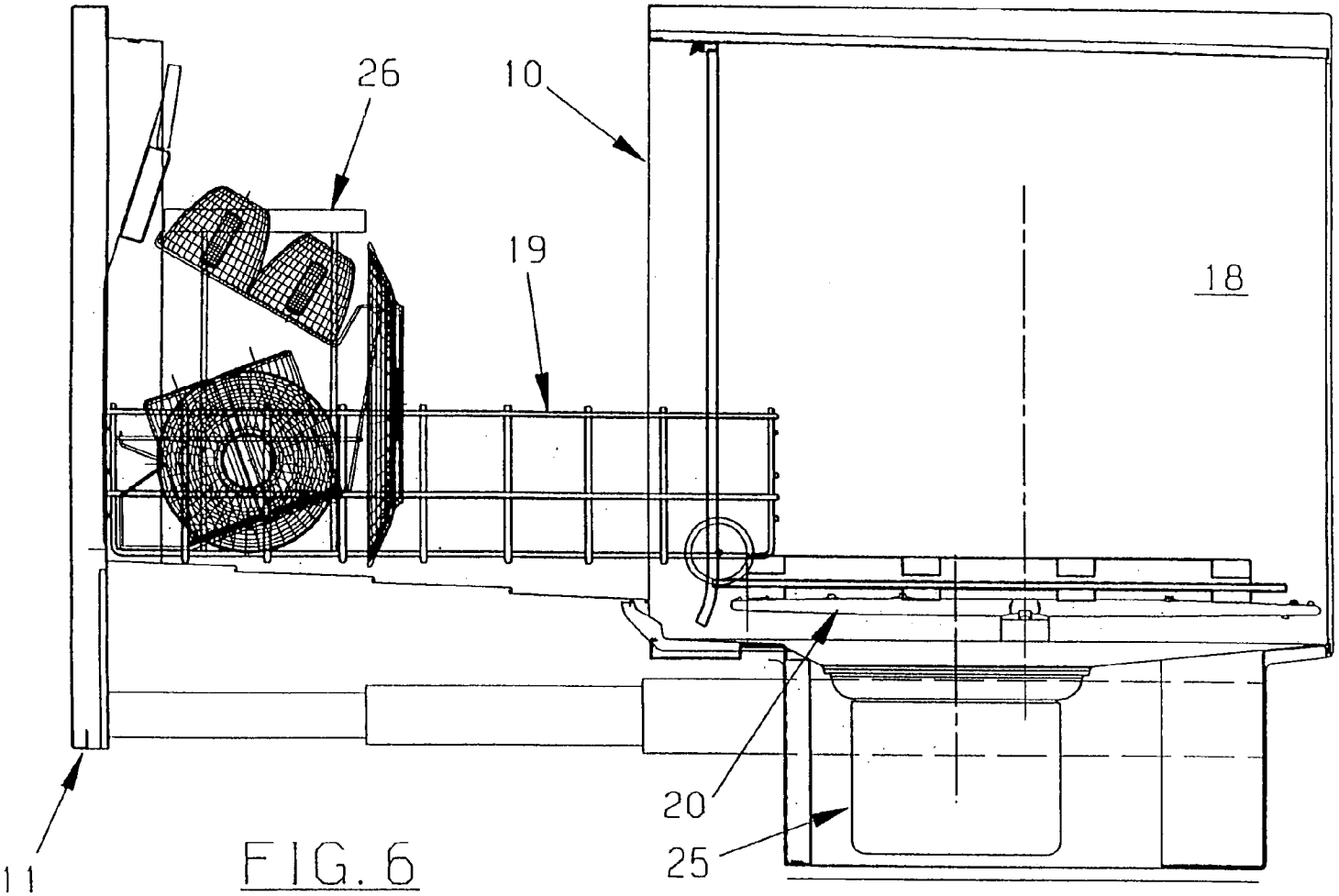
FIG. 6 is another schematic side view of the dishwasher per FIG. 1 or 2.

It should be noted that while using a single rack 19 for loading the dishes is preferred, it is equally possible, of course, to use two racks in a side-by-side, mutually linked arrangement, provided that the height for loading the dishes remains the same so as to ensure the ergonomically best solution for the user. It should also be noted that the design described makes it possible to use a tub 18 of considerable height i.e. vertical capacity, so that the rack 19 can be equipped with one or several upper levels 26 for baskets holding smaller dishes that have to be wetted with a gentler water jet (FIG. 5).

The solution according to the invention is particularly adaptable to dishwashers of the type described in the international patent application WO 00/72741 or in the European patent application No. 0202598.9, both filed by the author of this application. Those machines are equipped with a horizontally sliding operating unit that is firmly linked to the tub-sealing door.

As is readily evident, the dishwasher according to this invention does not require custom-designed components for serving the intended purpose but is based on the practical use of existing engineering concepts of the trade in a way as to achieve a higher degree of cost effectiveness, efficiency and versatility.

What is claimed is:

1. Automatic dishwasher, especially for built-in kitchenettes, comprising a cabinet (10) and equipped with a front door (11) that seals the wash tub (18) housing at least one first (20) and one second (21) spray arm for washing the dishes placed in at least one rack (19), said tub being closed on the bottom by a downward sloping panel (22) that directs the wash water into a sump hopper (23) which serves to collect and drain the water, said first and second spray arms being disposed vertically beneath said rack (19) adjacent said sloped panel (22), characterized in that the first spray arm (20) essentially extends coaxially with the sump hopper (23) while the second spray arm (21) is positioned above the sloped panel (22) with its axis of rotation extending at a right angle to said panel, wherein a plane of rotation of the second spray arm (21) partly extends underneath that of the first spray arm (20).

2. Dishwasher as in claim 1, characterized in that the sump hopper (23) serving to collect and drain the wash water is located in an off-center position on the bottom of the wash tub (18).

3. Dishwasher as in claim 1, characterized in that the door (11) extends across the full width of the cabinet (10) and that one single rack (19) serves to accommodate a standard load of dishes.

4. Dishwasher as in claim 1, characterized in that the door (11) is a solid component provided with a trim panel (15).

5. Dishwasher as in claim 1, characterized in that the door (11) features a transparent window (16) and an outside handle (17).

6. An automatic dishwasher, especially for built-in kitchenettes, comprising a cabinet (10) and equipped with a front door (11) that seals the wash tub (18) housing at least one first spray arm (20) and one second spray arm (21) each for projecting water in a generally upward direction within the wash tub (18) to wash dishes placed in a lowermost rack (19) disposed within the wash tub (18), said tub being closed on the bottom by a downward sloping panel (22) that directs the wash water into a sump hopper (23) which serves to collect and drain the water, said first and second spray arms both being disposed vertically beneath said rack (19) adjacent said sloped panel (22), characterized in that the first spray arm (20) essentially extends coaxially with the sump hopper (23) and the second spray arm (21) is positioned above the sloped panel (22) with its axis of rotation extending at a right angle to said panel, wherein a plane of rotation of the second spray arm (21) partly extends underneath that of the first spray arm (20).

7. Automatic dishwasher, especially for built-in kitchenettes, comprising a cabinet (10) and equipped with a front door (11) that seals the wash tub (18) housing at least one first (20) and one second (21) spray arm for washing the dishes placed in at least one rack (19), said tub being closed on the bottom by a downward sloping panel (22) that directs the wash water into a sump hopper (23) which serves to collect and drain the water, said first and second spray arms being disposed vertically beneath said rack (19) adjacent said sloped panel (22), characterized in that the first spray arm (20) essentially extends coaxially with the sump hopper (23) and the second spray arm (21) is positioned above the sloped panel (22) with its axis of rotation extending at a right angle to said panel, wherein a plane of rotation of the second spray arm (21) is angled to an extent to partly extend underneath a plane of rotation of the first spray arm (20) within the wash tub (18).

8. Automatic dishwasher, especially for built-in kitchenettes, comprising a cabinet (10) and equipped with a front door (11) that seals the wash tub (18) housing at least one first spray arm (20) and one second spray arm (21) each for washing the dishes placed in at least one rack (19), said tub being closed on the bottom by a downward sloping panel (22) that directs the wash water into a sump hopper (23) which serves to collect and drain the water, said first and second spray arms being disposed vertically beneath said rack (19) adjacent said sloped panel (22), characterized in that the first spray arm (20) essentially extends coaxially with the sump hopper (23) and the second spray arm (21) is positioned above the sloped panel (22) with its axis of rotation extending at a right angle to said panel, wherein a plane of rotation of the second spray arm (21) partly extends underneath that of the first spray arm (20), wherein at least a portion of water from the second spray arm (21) is to travel in a generally upward direction away from the sloped panel (22) and through the plane of rotation of the first spray arm (20) before being combined with a portion of water from the first spray arm (20) to form a high-intensity wash zone.

9. Automatic dishwasher, especially for built-in kitchenettes, comprising a cabinet (10) and equipped with a front door (11) that seals the wash tub (18) housing at least a first spray arm (20) that at least partially overlaps a second spray arm (21) to create a high-intensity wash zone for washing the dishes placed in at least one rack (19), said tub being closed on the bottom by a downward sloping panel (22) that directs the wash water into a sump hopper (23) which serves to collect and drain the water, said first and second spray arms being disposed vertically beneath said rack (19) adjacent said sloped panel (22), characterized in that the first spray arm (20) essentially extends coaxially with the sump hopper (23) and the second spray arm (21) is positioned above the sloped panel (22) with its axis of rotation extending at a right angle to said panel, wherein a plane of rotation of the second spray arm (21) above the sloped panel (22) extends between the rack (19) and a location vertically beneath a plane of rotation of the first spray arm (20).

10. The automatic dishwasher according to claim 9, wherein a height of the cabinet (10) is suitable for integrating the automatic dishwasher into kitchen cabinetry.

11. The automatic dishwasher according to claim 9, wherein the plane of rotation of the second spray arm (21) extends between a vertical elevation that is substantially equal to a vertical elevation of the plane of rotation of the first spray arm (20) and the location vertically beneath the plane of rotation of the first spray arm (20).

12. The automatic dishwasher according to claim 9 further comprising a low-profile motor-pump assembly (25) for direct feeding of water to the first spray arm (20).

13. The automatic dishwasher according to claim 9, wherein the first spray arm (20) is rotatably supported by the low-profile motor-pump assembly (25) and a branch extending from the low-profile motor-pump assembly (25) supplies water to the second spray arm (22).

* * * * *

UNITED STATES PATENT AND TRADEMARK OFFICE

CERTIFICATE OF CORRECTION

PATENT NO. : 8,377,226 B2
APPLICATION NO. : 10/525627
DATED : February 19, 2013
INVENTOR(S) : Favaro et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 816 days.

Signed and Sealed this
First Day of September, 2015

Michelle K. Lee

Michelle K. Lee
*Director of the United States Patent and Trademark Office*